US009623661B2

(12) United States Patent
Matsui et al.

(10) Patent No.: US 9,623,661 B2
(45) Date of Patent: Apr. 18, 2017

(54) PRINTING APPARATUS AND HEAD PROTECTION METHOD

(71) Applicant: CANON KABUSHIKI KAISHA, Tokyo (JP)

(72) Inventors: Monta Matsui, Tokyo (JP); Makoto Torigoe, Tokyo (JP); Atsuhiko Masuyama, Yokohama (JP); Naomi Yamamoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/928,915

(22) Filed: Oct. 30, 2015

(65) Prior Publication Data

US 2016/0121613 A1 May 5, 2016

(30) Foreign Application Priority Data

Nov. 4, 2014 (JP) ..... 2014-224699

(51) Int. Cl.
*B41J 2/165* (2006.01)

(52) U.S. Cl.
CPC ..... *B41J 2/165* (2013.01); *B41J 2/16508* (2013.01); *B41J 2/16585* (2013.01)

(58) Field of Classification Search
CPC ..... B41J 2/165; B41J 2/16585; B41J 2/16508
See application file for complete search history.

(56) References Cited

U.S. PATENT DOCUMENTS

2012/0194604 A1* 8/2012 Tamaki ..... B41J 2/165 347/22
2013/0241992 A1 9/2013 Shimizu

FOREIGN PATENT DOCUMENTS

| | | | |
|---|---|---|---|
| CN | 102205700 | A | 10/2011 |
| CN | 102615973 | A | 8/2012 |
| CN | 102848723 | A | 1/2013 |
| JP | 2012-245793 | A | 12/2012 |

* cited by examiner

*Primary Examiner* — Henok Legesse
(74) *Attorney, Agent, or Firm* — Canon USA, Inc. IP Division

(57) ABSTRACT

An apparatus includes a print head, a cap unit configured to cap a portion including a nozzle of the print head to form a small space, and a supply unit configured to supply gas for protecting the nozzle to the small space, wherein the supply unit performs a charge on another space to be connected to the small space to have a pressure different from that in the small space, and supplies the gas to the small space by a gas flow generated by releasing the charge.

7 Claims, 9 Drawing Sheets

FIG.8

| | HUMIDIFICATION TIME (SEC) | NOZZLE DISCHARGE STATUS |
|---|---|---|
| EXEMPLARY EMBODIMENT | 90.0 | GOOD |
| | 120.0 | GOOD |
| COMPARATIVE EXAMPLE | 90.0 | POOR |
| | 120.0 | GOOD |

PRINTING APPARATUS AND HEAD PROTECTION METHOD

BACKGROUND OF THE INVENTION

Field of the Invention

The present invention relates to a printing apparatus capable of protecting a print head from dryness with humidified gas.

Description of the Related Art

In an ink jet printing apparatus, when ink is not discharged from the print head for a long time, ink viscosity in a nozzle increases. This causes clogging of the nozzle. According to Japanese Patent Application Laid-Open No. 2012-245793, a portion including nozzles of a line print head is capped to form a small space (a discharge space), and humidified gas generated by a supply unit (a humidification mechanism) is supplied to the small space. Thus, moisture of the nozzles is retained, and dryness of the nozzles is restrained.

However, in a case where the humidified gas is supplied from the supply unit to the small space at a low speed, humidification of the nozzles consumes longer time. This cannot enhance humidification efficiency. Moreover, the supply of humidified gas at a low speed may cause liquefaction of the humidified gas in a middle portion of a path before the humidified gas reaches the small space. Consequently, moisture of the nozzles may not be retained sufficiently, and the nozzles may not be protected. As a length of the print head is longer, such problems become more significant.

SUMMARY OF THE INVENTION

According to an aspect of the present invention, an apparatus includes a print head, a cap unit configured to cap a portion including a nozzle of the print head to form a small space, and a supply unit configured to supply gas for protecting the nozzle to the small space, wherein the supply unit performs a charge on another space to be connected to the small space to have a pressure different from that in the small space, and supplies the gas to the small space by a gas flow generated by releasing the charge.

Further features of the present invention will become apparent from the following description of exemplary embodiments with reference to the attached drawings.

BRIEF DESCRIPTION OF THE DRAWINGS

FIG. 8 is a table illustrating nozzle protection differences between the presence and absence of depressurization charge.

DESCRIPTION OF THE EMBODIMENTS

Figure 1A:
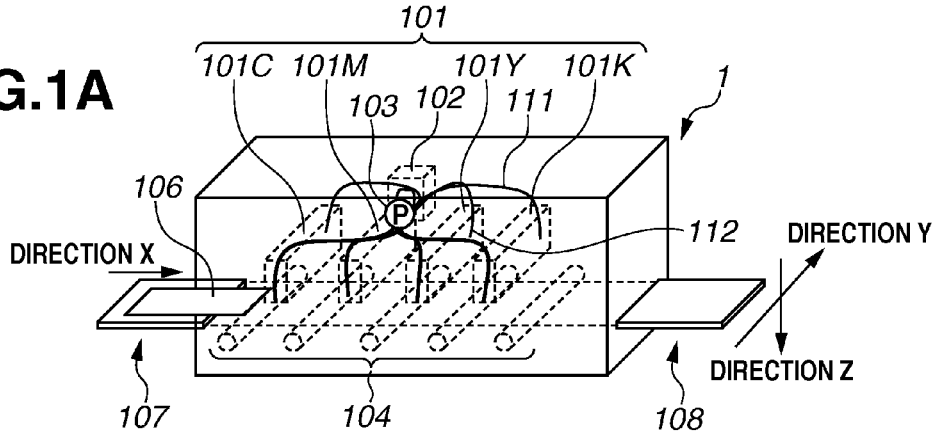
FIGS. 1A, 1B, and 1C are diagrams illustrating an overall configuration of a printing apparatus including a humidification mechanism.
Figure 1B:
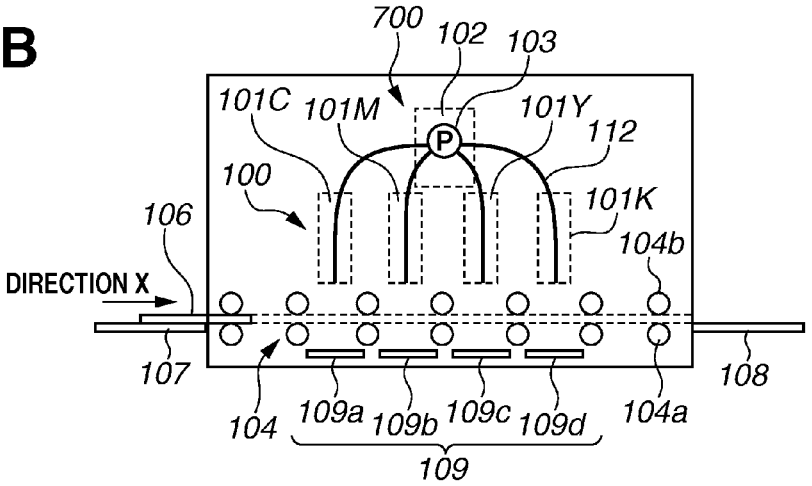
Figure 1C:
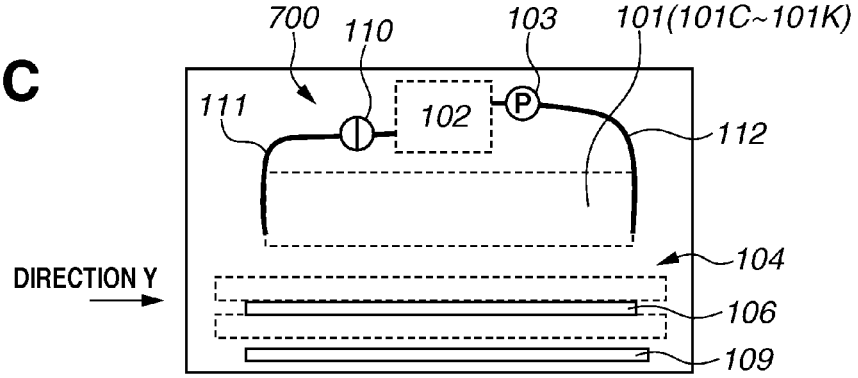

A printing apparatus according to an exemplary embodiment of the present invention is described. FIGS. 1A, 1B, and 1C are diagrams illustrating an overall configuration of a printing apparatus 1 including a humidification mechanism. FIG. 1A is a perspective view of the printing apparatus 1. FIG. 1B is a sectional view of the printing apparatus 1 as seen from a direction (Y) perpendicular to a sheet conveyance direction (X), whereas FIG. 1C is a sectional view of the printing apparatus 1 as seen from an upstream side in the sheet conveyance direction (X).

A printing apparatus 1 includes a sheet conveyance system and a printing unit 100. The sheet conveyance system handles a sheet serving as a recording medium, and the printing unit 100 forms an image on a sheet by discharging ink to the sheet being conveyed. The sheet conveyance system includes a feeding unit 107 for feeding stacked sheets (cut sheets) one by one, a conveyance unit 104 for conveying the sheet to the printing unit 100, and an ejection unit 108 for ejecting a printed sheet. The conveyance unit 104 includes a plurality of roller pairs arranged along a path. Each roller pair includes a drive roller 104*a* and a driven roller 104*b*, and rotates with a sheet nipped therebetween.

The printing unit 100 includes print heads 101C, 101M, 101Y, and 101K (collectively referred to as print head 101) for four colors of cyan, magenta, yellow, and black (CMYK), respectively. Each of the print heads 101 is an inkjet-type line head, and includes nozzles formed in an area covering the entire width of a sheet. A sheet 106 sequentially passes the print heads 101C, 101M, 101Y, and 101K, so that a color image is formed on the sheet 106 by a line print method. Inkjet printing may include any of bubble-jet (trademark) method, a method using a piezoelectric element, a method using an electrostatic element, and a method using a micro electro mechanical system (MEMS) element. The sheet 106 with the printed image is ejected by the ejection unit 108 to a tray on which the sheet 106 is stacked one on another.

The printing apparatus 1 further includes a humidification unit 700 and a cap unit 109. The humidification unit 700 generates and supplies humidified gas to prevent the nozzles of each print head 101 of the printing unit 100 from dryness (ink thickening). The cap unit 109 caps a plane (a nozzle plane), on which the nozzles of each print head 101 are provided, to form a small space so that the humidified gas supplied from the humidification unit 700 is trapped in the small space. Accordingly, when the print head is not in use, the nozzles exposed to the small space are protected by the humidified gas. This prevents an ink discharge failure. In the present specification, such an operation of supplying the humidified gas to the capped small space for nozzle protection is referred to as "a head protection operation".

The humidification unit 700 includes a generation unit 102, a pump 103, a valve 110, a first channel 112 (on a supply side) in which gas flows, and a second channel 111 (on a collection side) in which gas flows. The generation unit 102 generates humidified gas having a humidity higher than that of an installation environment of the printing apparatus 1. The pump 103 produces a flow of gas. The valve 110 can be opened and closed to block the flow of the gas. The valve 110 is arranged in a middle portion of the second channel 111, whereas the pump 103 is arranged in a middle portion of the first channel 112. The pump 103 may be arranged in the second channel 111, whereas the valve 110 may be arranged in the first channel 112. The pump 103 and the valve 110 may be arranged in the second channel 111 and the first channel 112, respectively. Alternatively, both of the pump 103 and the valve 110 may be arranged in the first channel 112 or the second channel 111.

The first channel 112 on the supply side branches into a plurality channels at a position beyond the pump 103. The branched channels are connected to respective small spaces formed in the plurality of print heads 101. The humidified gas generated by the generation unit 102 is supplied to the small spaces of the plurality of the print heads 101 via the pump 103. The generation unit 102, the first channel 112, the second channel 111, the pump 103, and the valve 110 form a supply unit that generates humidified gas and supplies the generated gas to the small spaces for protecting the print heads. The small spaces are described in detail below.

The small spaces of the print heads 101 are connected to the respective second channels 111 which are combined into one channel just short of the valve 110. The one channel is connected to the generation unit 102 via the valve 110. The humidified gas flowing from the small space of each of the plurality of print heads 101 to the second channel 111 is collected by the generation unit 102 via the valve 110.

Figure 2A:
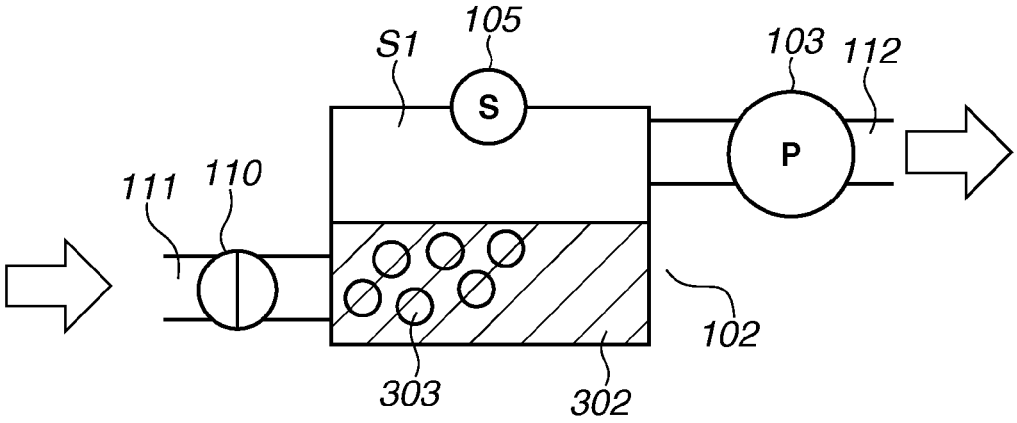
FIGS. 2A, 2B, and 2C are enlarged views each illustrating a configuration of a supply unit (periphery of a generation unit).
Figure 2B:
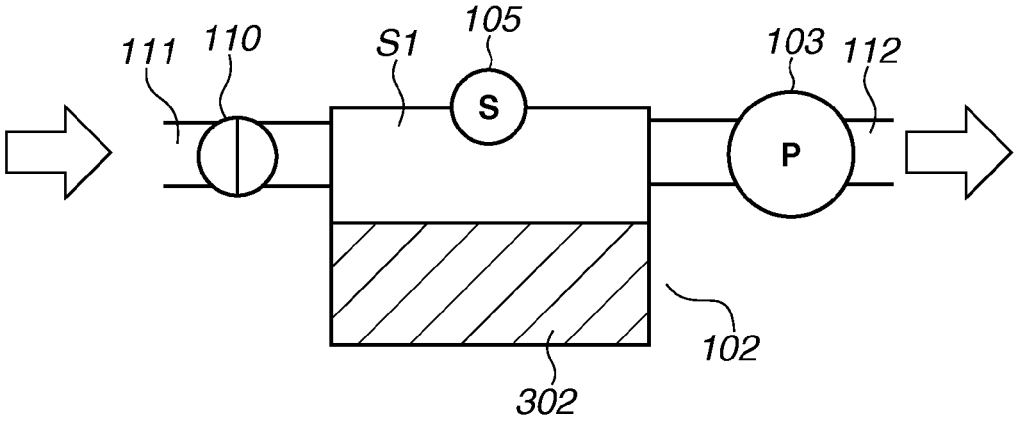
Figure 2C:
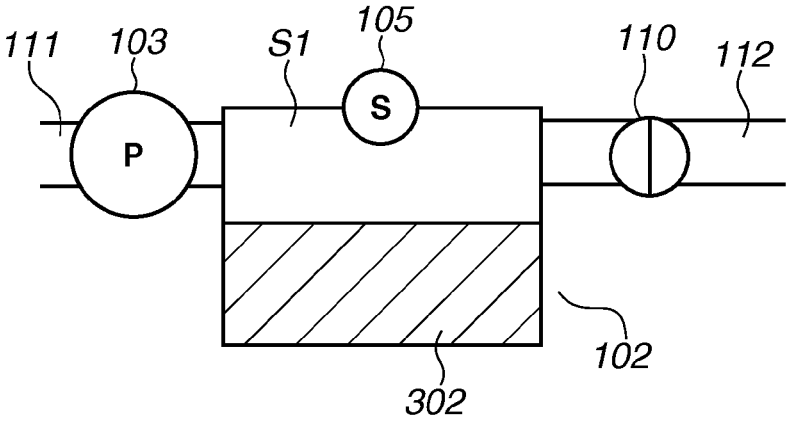

FIGS. 2A, 2B, and 2C illustrate three configuration examples of the supply unit (the periphery of the generation unit 102). FIG. 2A illustrates a first example of the supply unit. The generation unit 102 stores a humidification liquid 302 (water in this example). The second channel 111 and the generation unit 102 are connected below a water surface of the humidification liquid 302, whereas the first channel 112 and the generation unit 102 are connected above the water surface of the humidification liquid 302. A sensor 105 disposed in the generation unit 102 detects a temperature and a humidity in the generation unit 102.

FIG. 2B illustrates a second example of the supply unit. The second channel 111 and the generation unit 102 are connected above the humidification liquid 302, unlike the connection thereof illustrated in FIG. 2A. FIG. 2C is a third example of the supply unit. Positions of the valve 110 and the pump 103 are switched from those illustrated in FIGS. 2A and 2B. In FIG. 2C, the valve 110 and the pump 103 are arranged in the first channel 112 and the second channel 111, respectively.

In the example illustrated in FIG. 2A, gas that has flowed from the second channel 111 into the generation unit 102 becomes many bubbles 303. Such bubbles 303 rise in the humidification liquid 302. At this time, humidity of the gas in the bubble is increased. This results in generation of humidified gas having a high humidity. In the example illustrated in FIG. 2B, gas that has flowed from the second channel 111 into the generation unit 102 passes a space above the humidification liquid 302. This increases the humidity of the gas, thereby generating humidified gas having a high humidity. In the example illustrated in FIG. 2C, when the pump 103 is driven, gas is pulled out from the second channel 111 and fed into the generation unit 102. Then, the gas passes a space above the humidification liquid 302, so that humidified gas is generated. In any of the examples illustrated in FIGS. 2A, 2B, and 2C, the driving of the pump 103 can produce a flow of the humidified gas from the generation unit 102 to the first channel 112.

Herein, if the valve 110 is closed, an inflow of the gas into the generation unit 102 or an outflow of the gas from the generation unit 102 is blocked. In each of the examples illustrated in FIGS. 2A and 2B, if the pump 103 is driven with the valve 110 closed, a space S1 above the humidification liquid 302 in the generation unit 102 is depressurized. In the example illustrated in FIG. 2C, on the other hand, if the pump 103 is driven with the valve 110 closed, the space S1 is pressurized.

Accordingly, the pump 103 is driven with the valve 110 closed to temporarily form another space having a pressure different from that in the small space (described below) which covers nozzles. Such an operation is referred to as "a charge" in the present specification. A depressurized state is created by a depressurization charge, and a pressurized state is created by a pressurization charge. In the present invention, it is important that the other space to be connected to the small space which caps the nozzles of the print head undergoes the charge and release of the charge. Such importance is described in detail below. In each of the examples illustrated in FIGS. 2A and 2B, if the pump 103 is driven in reverse (a pump motor is rotated in reverse) with the valve 110 closed, the space S1 undergoes the pressurization charge. In the example illustrated in FIG. 2C, on the other hand, if the pump 103 is driven in reverse (a pump motor is rotated in reverse) with the valve 110 closed, the space S1 undergoes the depressurization charge.

Figure 3:
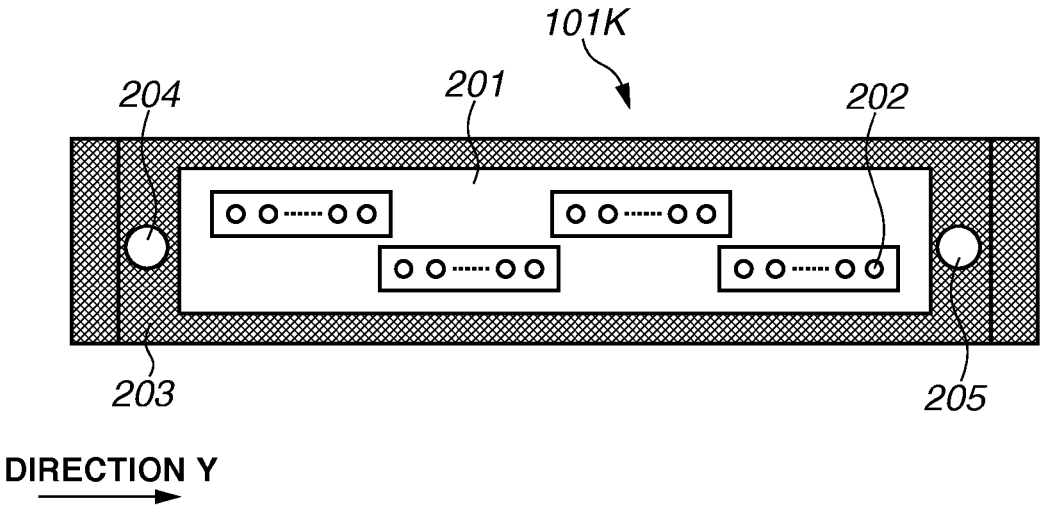
FIG. 3 is a diagram illustrating a nozzle plane of one print head as seen from the bottom.

FIG. 3 is a diagram illustrating a nozzle plane 201 of one print head 101 as seen from the bottom. The nozzles are formed on the nozzle plane 201. Each of the print heads 101C, 101M, 101Y, and 101K has a similar configuration. On the nozzle plane 201, nozzle chips are arranged in a staggered pattern. The nozzle chip includes a predetermined number of nozzles 202 that are arranged in one direction. A plurality of nozzle chips is arranged, so that a line head includes the nozzles arranged to an extent that can cover a maximum possible sheet width. A seal member 203 covers the periphery of the nozzle plane 201. The seal member 203 is made of a material including flexible rubber. The seal member 203 serves as a sealing unit projecting downward relative to the nozzle plane 201. The nozzle plane 201 includes a hole 204 on one end thereof and a hole 205 on the other end thereof. The second channel 111 is connected to the hole 204, and the first channel 112 is connected to the hole 205.

Figure 4A:
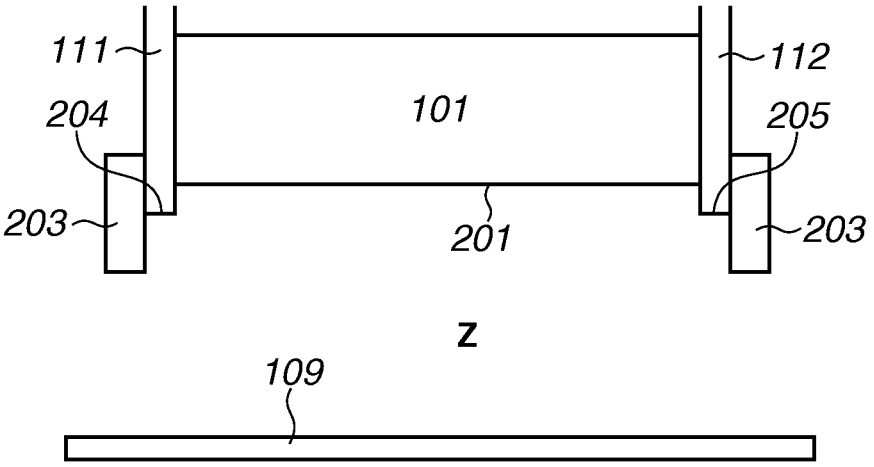
FIGS. 4A and 4B are diagrams illustrating formation of a small space by capping nozzles.
Figure 4B:
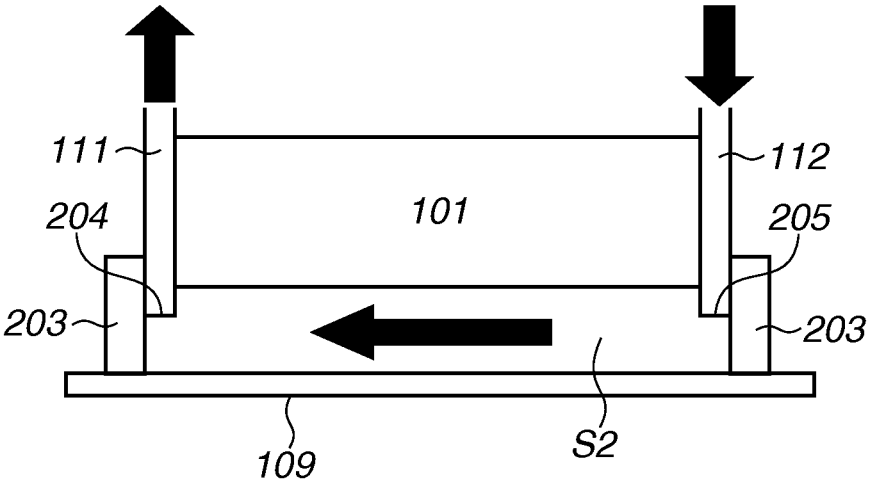

FIGS. 4A and 4B are diagrams illustrating formation of the small space by capping the nozzles. FIG. 4A illustrates a cap open state in which the cap unit 109 is retracted below the drive roller 104*a*. FIG. 4B illustrates a cap closed state in which the cap unit 109 contacts the seal member 203 and the small space is formed. Accordingly, there are two states as illustrated in FIGS. 4A and 4B.

In the cap open state, the cap unit 109 arranged to face the nozzle plane 201 is moved toward the nozzle plane 201 by a movement mechanism including a motor to contact the seal member 203. When the cap unit 109 contacts the seal member 203, a portion including the nozzles 202 is capped, thereby forming a small space S2 (FIG. 4B) hermetically sealed by the seal member 203. Accordingly, the cap open state is shifted to the cap closed state. The cap unit 109 and the print head 101 may move to be relatively close to each other. Any one or both of the cap unit 109 and the print head 101 may move with respect to the counterpart.

In the cap closed state (FIG. 4B), humidified gas is supplied from the first channel 112 to the small space S2 via the hole 205, and the small space S2 is filled with the humidified gas. Since the nozzles exposed to the small space S2 are covered with the humidified gas, thickening of ink due to evaporation is suppressed. The humidified gas in the small space S2 is discharged from the hole 204 to the second channel 111.

Figure 5:
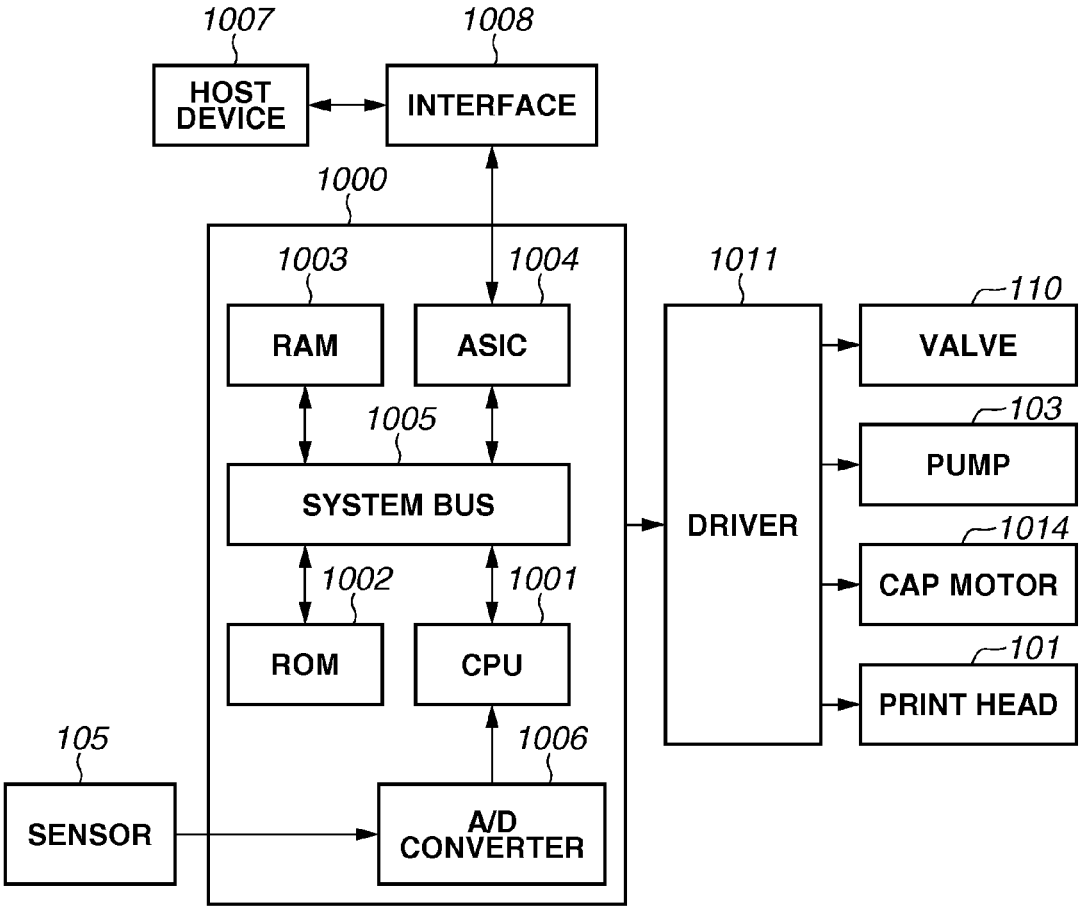
FIG. 5 is a block diagram illustrating a control system of the printing apparatus.

FIG. 5 is a block diagram illustrating a control system of the printing apparatus 1. A control unit 1000 includes a central processing unit (CPU) 1001, a read only memory (ROM) 1002, a random access memory (RAM) 1003, an application specific integrated circuit (ASIC) 1004, a system bus 1005, and an analog digital (A/D) converter 1006. The ROM 1002 stores programs to execute various sequences of the entire apparatus including a humidification operation. The ASIC 1004 generates a control signal for a control operation. The RAM 1003 includes a loading area of image data and a work area for execution of a program. The system bus 1005 connects each of these units so that data is mutually exchanged therebetween. The A/D converter 1006 receives signals from the sensor 105 and other sensors, and converts the received signal into a digital signal. Then, the A/D converter 1006 supplies the digital signal to the CPU 1001. A host device 1007 is a computer serving as a supply source of image data. Between the printing apparatus 1 and the host device 1007, for example, image data, a command, and a status signal are transmitted and received, via an interface 1008. A driver 1011 drives the valve 110, the pump 103, a cap motor 1014, the print head 101, and other drive units of the printing apparatus 1.

Figure 6:
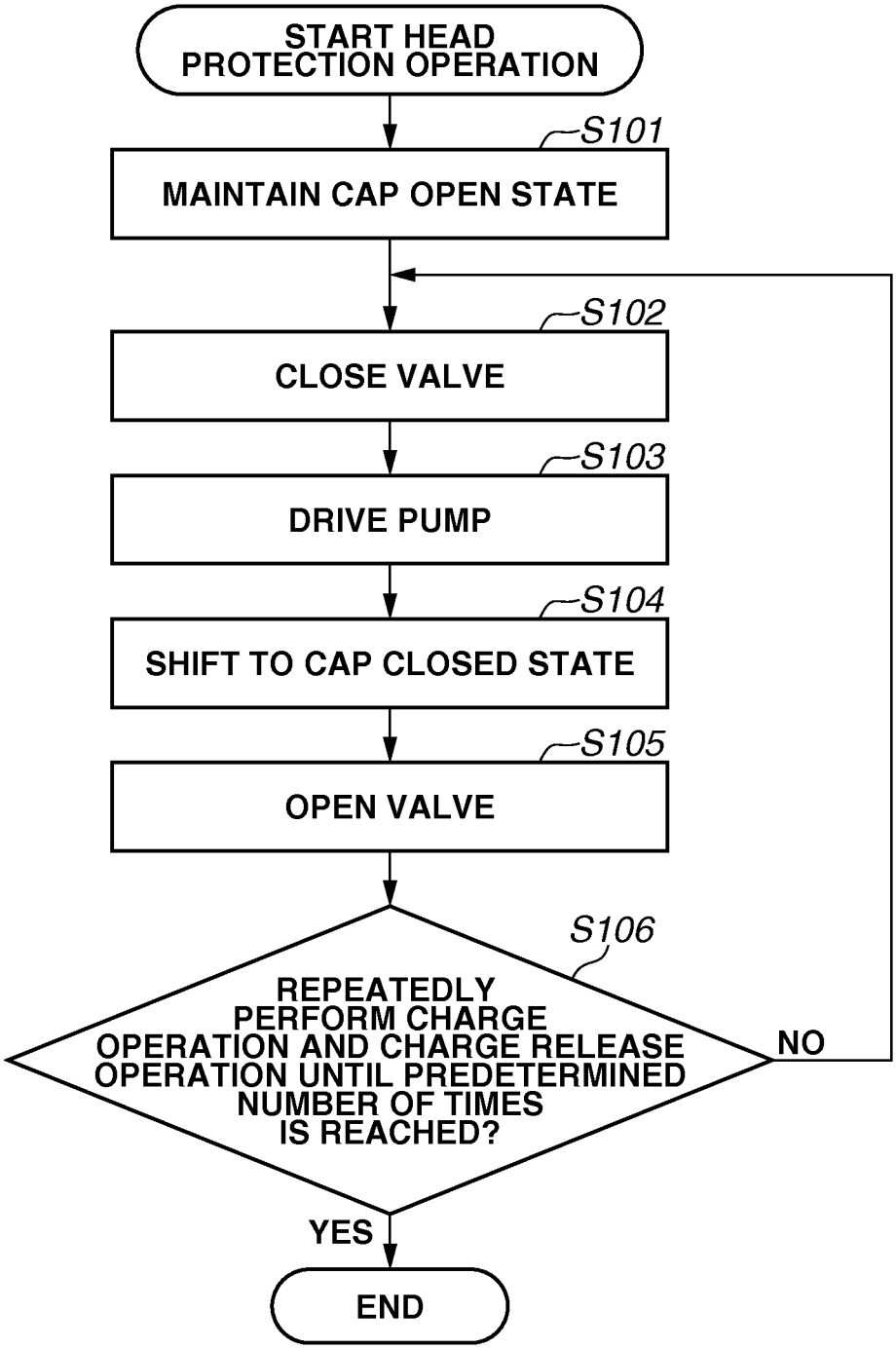
FIG. 6 is a flowchart illustrating a sequence of a head protection operation.

FIG. 6 is a flowchart illustrating a sequence for performing a head protection operation for feeding humidified gas to a small space. FIGS. 7A, 7B, 7C, and 7D are diagrams illustrating the head protection operation. The head protection operation is executed by the control system illustrated in FIG. 5.

In a printing operation for forming an image by discharging ink to a sheet, the cap unit 109 is in a cap open state. When the printing operation is finished or a power-off command is issued to the printing apparatus 1, the head protection operation starts and the sequence illustrated in FIG. 6 is executed.

Figure 7A:
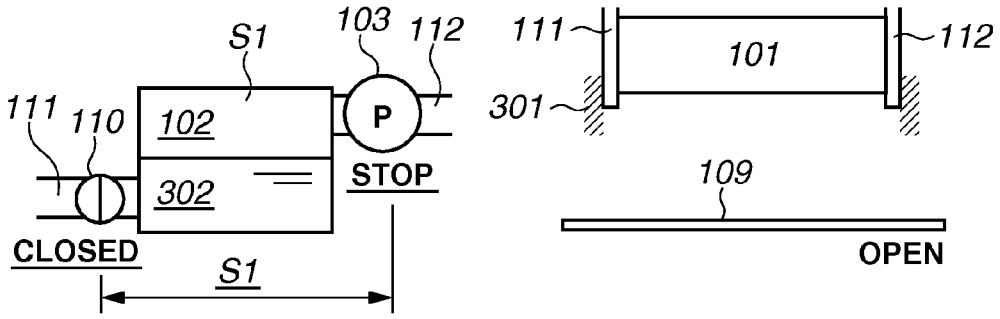
FIGS. 7A, 7B, 7C, and 7D are diagrams illustrating the head protection operation.

In step S101, the control system maintains the cap unit 109 in the cap open state which is used when a printing operation is performed. In step S102, the control system closes the valve 110. If the valve 110 has already been closed, the valve 110 remains closed as is. The closure of the valve 110 blocks a flow of gas from the second channel 111 to the generation unit 102. Herein, the cap unit 109 is in the cap open state (FIG. 7A).

Figure 7B:
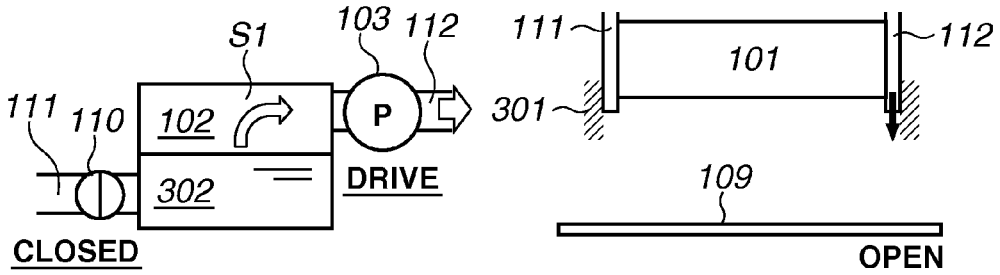

In step S103, the control system drives the pump 103 which has been stopped. Since the valve 110 is closed, the space S1 is closed. The gas inside the space S1 is discharged by the pump 103. This enables the space S1 to be gradually depressurized. Herein, the cap unit 109 remains in the cap open state (FIG. 7B). The control system continues driving the pump 103 for a predetermined time (in this example, 30 seconds), so that the space S1 undergoes a sufficient depressurization charge. In each of the examples illustrated in FIGS. 2A and 2B, the pump motor rotates forward. In the example illustrated in FIG. 2C, the pump motor reversely rotates. In any of the examples, the pump motor rotates to depressurize the space S1.

Such depressurization efficiently increases the humidity of the space S1, so that humidified gas is generated. Generation efficiency of the humidified gas largely depends on temperature. The higher the temperature, the greater the generation efficiency. A temperature inside the generation unit 102 fluctuates according to a temperature inside the printing apparatus 1 and a temperature of the installation environment of the printing apparatus 1. Hence, a charge operation time may be changed according to temperature information detected by the sensor 105 disposed near the generation unit 102. For example, if a temperature is 20 degrees Celsius or higher, a charge operation is set to 30 seconds. If a temperature is lower than 20 degrees Celsius, a charge operation is set to 45 seconds. Since the sensor 105 can detect a temperature and a humidity, the sensor 105 monitors the humidity of the humidified gas generated in the space S1.

Figure 7C:
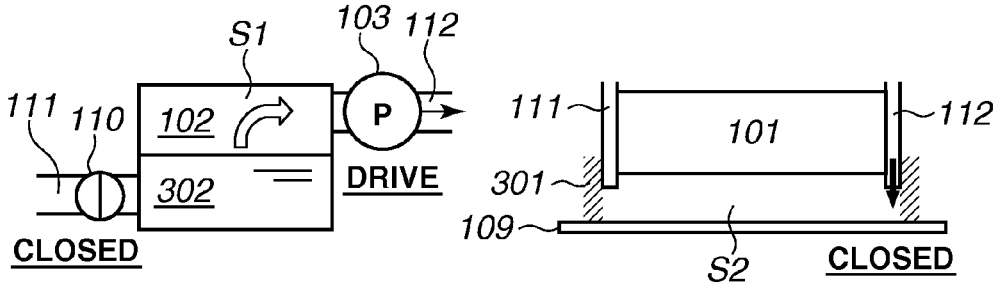

In step S104, the control system moves the cap unit 109 while driving the pump 103, so that the cap unit 109 is shifted to a cap closed state (FIG. 7C). In the cap closed state, the small space S2 is closed. Thus, the small space S2 and the space S1 are circularly connected by the second channel 111 and the first channel 112, thereby forming one closed circulation path. Herein, the space S1 still undergoes the depressurization charge.

Figure 7D:
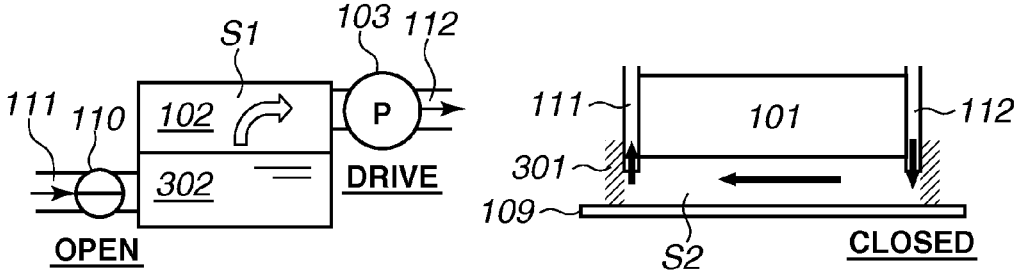

In step S105, when the cap unit 109 is shifted to the cap closed state, the control system opens the valve 110 which has been closed. The pump 103 remains driven. Accordingly, the depressurization charge of the space S1 is released, so that a strong gas flow is generated in the circulation path by pulling the gas from the second channel 111 to the space S1 to eliminate a pressure difference between the space S1 (negative pressure) and the small space S2 (atmospheric pressure). With such a gas flow, the humidified gas generated in the generation unit 102 is fed to the small space S2 without stopping. Hence, the small space S2 is filled with the humidified gas (FIG. 7D).

Herein, the valve 110 is opened for a short time (herein, 1 second) and then closed again. When the valve 110 is opened, a large gas flow is generated instantly. This enables the humidified gas to be sufficiently distributed across the small space S2. Since the valve 110 is closed immediately, the depressurization charge of the generation unit 102 is not fully released, that is, some depressurization charge remains. Consequently, a time necessary to reacquire a target depressurization is shorter. This is effective when a charge operation is repeatedly performed.

In step S106, the control system repeats the charge operation and the charge release operation until the predetermined number of times is reached (in this example, three times, a total of 90 seconds). If the predetermined number of times is reached (YES in step S106), the control system stops driving the pump 103 and closes the valve 110. Then, the sequence of the head protection operations ends. If the small space S2 is sufficiently filled with the humidified gas by one charge release operation, a repeat of the processing in step S106 may be omitted. The cap open state provided in the charge operation as illustrated in FIG. 7B maintains good nozzle meniscus of the inkjet head. In a case where a charge operation is performed in a cap closed state, the humidified gas fed by the pump 103 causes the small space S2 to be pressurized. This may affect ink meniscus (air-water interface) in a leading edge of the nozzle. In some instances, the meniscus may not be affected. In such a case, the cap closed state as illustrated in FIG. 7C can be provided from the beginning, and the charge operation can be performed.

When a printing operation is not performed for a certain time or longer, or when a power supply of the printing apparatus 1 is off, the small space S2 is filled with the humidified gas by execution of the head protection operation and the cap closed state is maintained. In such a case, since the pump 103 is not driven and the gas is static with the valve 110 closed, the humidified gas barely leaks from the small space S2. Therefore, even if a printing operation is not performed for a long time, dryness of the nozzles of the print head 101 is suppressed.

Next, advantages of the present exemplary embodiment are described by comparing the present exemplary embodiment (the presence of depressurization charge) with a comparative example (the absence of depressurization charge). FIG. 8 is a table illustrating differences in nozzle protection results (discharge failures) based on comparison between the presence and absence of depressurization charge. Herein, a discharge status (good, poor) of ink was determined after a head protection operation was performed. In the present exemplary embodiment, a charge operation was performed when humidified gas was supplied. In the comparative example, on the other hand, humidified gas was supplied to a small space S2 by only a pump without a charge operation.

As illustrated in FIG. 8, in the present exemplary embodiment, a nozzle discharge status was good when a humidification time was any of 90 seconds (the charge was performed 3 times) and 120 seconds (the charge was performed 4 times), and a discharge failure did not occur. In the comparative example in which a charge operation was not performed, on the other hand, a nozzle discharge status was good when a humidification time was 120 seconds. However, when the humidification time was shortened, a discharge failure occurred in one portion on a downstream side of the nozzle (the hole 204 side through which the gas was discharged from the small space). Therefore, the present exemplary embodiment is more effective than the comparative example since the entire small space S2 is filled with the humidified gas in a shorter time by the strong gas flow generated by releasing the depressurization charge. Particularly, in the line head, the small space S2 serves as an elongated channel in which an upstream side and a downstream side of a flow is distant from each other. Thus, if the charge operation is not performed, distribution of the humidified gas to the downstream side requires time, and the nozzle on the downstream side does not tend to be protected. The longer the line head, the more effect the charge operation achieves by supplying gas.

Even when a volume of the humidified gas stored in the generation unit 102 was halved, a discharge status of the present exemplary embodiment was not deteriorated. According to the present exemplary embodiment, that is, even when a small amount of the humidified gas is used, the similar effect can be achieved and size of the generation unit 102 can be reduced.

Figure 9:
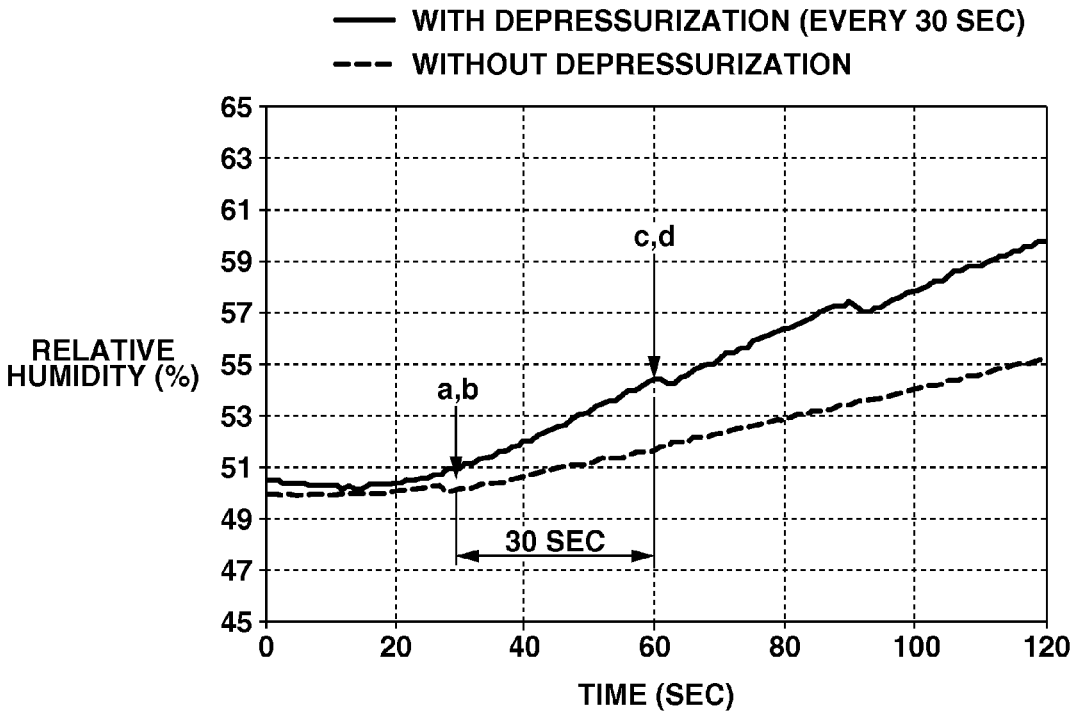
FIG. 9 is a graph illustrating an advantage in depressurization charge of a space S1.

FIG. 9 is a graph illustrating further advantages of a depressurization charge of the space S1. In the graph illustrated in FIG. 9, a horizontal axis and a vertical axis indicate time (sec) and a relative humidity (%), respectively. A solid line indicates a change in the relative humidity in the present exemplary embodiment (the presence of depressurization), whereas a broken line indicates a change in the relative humidity in the comparative example (the absence of depressurization). Points a, b, c, and d in the graph indicate timing of the operations illustrated in FIGS. 7A, 7B, 7C, and 7D, respectively.

A relative humidity of each of the present exemplary embodiment and the comparative example was approximately 50% during first 30 seconds, that is, prior to the supply of the humidified gas. Subsequently, in present exemplary embodiment, a depressurization charge of the humidified gas was started. As the depressurization of the space S1 gradually proceeded with the driving of the pump 103, evaporation of the humidified gas was facilitated. This increased the relative humidity inside the space S1. As a result, a relative humidity of the humidified gas to be supplied to the small space S2 was increased, and an effect of the nozzle protection in the small space S2 was enhanced.

In the comparative example (the absence of depressurization charge), on the other hand, since the pump 103 was driven with the valve 110 opened, the space S1 was not depressurized. Consequently, the relative humidity of the comparative example was lower than that of the present exemplary embodiment.

The charge operation was repeated every 30 seconds. In the present exemplary embodiment, the relative humidity reached 60% after 120 seconds elapsed. In the comparative example (the absence of the depressurization charge), the relative humidity stayed at 55%. In other words, in the present exemplary embodiment, only 70 seconds were needed to reach the relative humidity of 55%. In the comparative example, on the other hand, 120 seconds were needed to reach the relative humidity of 55%. Accordingly, the space S1 in which humidified gas is generated is depressurized by the depressurization charge, so that the humidified gas having a high humidity is efficiently generated, and a humidification effect of the small space S2 is further enhanced.

In the present exemplary embodiment, therefore, the space S1 including the generation unit of humidified gas undergoes a depressurization charge to intentionally generate a pressure difference between the space S1 and the small space S2 covering the nozzles. Then, the humidified gas is supplied to the small space S2 in a short time by the gas flow, which is generated when the charge is released to eliminate the pressure difference. With the strong gas flow generated by the charge, the humidified gas is distributed to a downstream of the small space S2 in a short time. As a length of the print head is longer in a large printing apparatus, such an effect becomes more obvious. Moreover, the depressurization of the space S1 in which humidified gas is generated enhances generation efficiency (relative humidity) of the humidified gas, thereby protecting the nozzles more efficiently.

Alternatively, the space S1 may undergo a pressurization charge instead of the depressurization charge to supply humidified gas using a pressure difference with the space S2. When the pressurization charge is performed, the pump 103 is driven in a direction opposite to that in the above example while the valve 110 is closed. That is, in each of the examples illustrated in FIGS. 2A and 2B, the pump motor makes reverse rotations. In the example illustrated in FIG. 2C, the pump motor makes forward rotations. Then, the gas is fed to the space S1, and the space S1 is pressurized and charged. When the valve 110 is opened to release the charge, the humidified gas of the pressurized space S1 is distributed to the entire circulation channel without stopping.

In the exemplary embodiment, the pump 103 is used in the charge operation with respect to the space S1. However, the exemplary embodiment is not limited thereto. For example, a cylinder unit may be used to perform a charge operation to depressurize or pressurize a space.

Moreover, in addition to the line printer, the exemplary embodiment of the present invention can be applied to a serial printer in which a carriage including a print head makes reciprocating movements to perform a printing operation. In such a case, the carriage is moved above a cap unit disposed outside a sheet, thereby performing a capping operation. The humidification mechanism described above is attached to such a cap unit, so that humidified gas is supplied by a charge operation.

Moreover, the exemplary embodiment of the present invention is not limited to the printing apparatus. The exemplary embodiment of the present invention can be applied to an inkjet apparatus used for operations other than the printing operation. Moreover, the exemplary embodiment of the present invention can be applied to a three dimensional (3D) printer. As for a printer head used in the 3D printer, clogging may occur due to a molding material that remains in a nozzle. When the 3D printer is not in use, the nozzle can be exposed to humidified gas or inactive gas. This can suppress solidification of the molding material. Therefore, in the present exemplary embodiment of the present invention, gas for protecting the nozzles is not limited to humidified gas. A specific gas such as inactive gas may be used for nozzles protection.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-224699, filed Nov. 4, 2014, which is hereby incorporated by reference herein in its entirety.

What is claimed is:

1. An apparatus comprising:

a print head having a nozzle portion;

a cap unit configured to form a small capping space surrounding the nozzle portion;

a humidifying unit configured to provide humidified gas in a humidified space;

a first channel being connected between the humidified space and a first side of the capping space;

a second channel being connected between the humidified space and a second side of the capping space which is apart from the first side;

a pump disposed in the first channel configured to generate a gas flow;

a valve disposed in the second channel configured to close the second channel; and a control unit configured to control at least the pump and the valve such that, the valve closes and the pump operates in order to make the humidified space to be a depressurized state or a pressurized state, then the valve opens while the capping space is formed in order to release the depressurized state or the pressurized state, thereby the humidified gas in the humidified space is distributed to the capping space in a short time through the first channel or the second channel to fill the capping space with the humidified gas.

2. The apparatus according to claim 1, wherein the print head is an inkjet line head having the nozzle portion extending between the first side and the second side.

3. The apparatus according to claim 2, wherein a plurality of the print heads are arranged, and the humidifying unit and the pump are used in common for the plurality of the print heads.

4. The apparatus according to claim 2, wherein, while a printing operation of the print head is not performed, the cap unit caps the print head and the capping space is filled with the humidified gas to protect the nozzle portion.

5. The apparatus according to claim 2, further comprising a sensor configured to detect a temperature in a vicinity of the humidifying unit, wherein a charge time of the pump is changed according to a detection result of the sensor.

6. The apparatus according to claim 2, wherein the humidified space is charged to be the depressurized state, and the humidified gas in the humidified space is distributed to the capping space by releasing the depressurized state.

7. The apparatus according to claim 2, wherein the humidified space is charged to be the pressurized state, and the humidified gas in the humidified space is distributed to the capping space by releasing the pressurized state.

* * * * *